US007422466B1

(12) United States Patent
Arai

(10) Patent No.: US 7,422,466 B1
(45) Date of Patent: Sep. 9, 2008

(54) CONNECTOR WITH COVER FOR A LATCHING PART

(75) Inventor: Atsushi Arai, Toyama (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 11/952,300

(22) Filed: Dec. 7, 2007

(30) Foreign Application Priority Data

Jun. 18, 2007 (JP) ..... 2007-160444

(51) Int. Cl.
*H01R 13/627* (2006.01)

(52) U.S. Cl. ..... 439/353; 439/357

(58) Field of Classification Search ..... 439/353, 439/352, 357

See application file for complete search history.

(56) References Cited

U.S. PATENT DOCUMENTS 5,779,495 A * 7/1998 Dechelette et al. ..... 439/353
5,984,705 A * 11/1999 Miyazaki et al. ..... 439/304
6,296,508 B1 * 10/2001 Kuwahara et al. ..... 439/353
7,234,957 B2 * 6/2007 Wang ..... 439/353
2008/0057769 A1 * 3/2008 Mase et al. ..... 439/352

FOREIGN PATENT DOCUMENTS

JP 2001-257027 9/2001
JP 2001-257057 9/2001
JP 2002-009326 1/2002

* cited by examiner

*Primary Examiner*—Hae Moon Hyeon
(74) *Attorney, Agent, or Firm*—Darby & Darby

(57) ABSTRACT

A connector having a plug and a socket that may be electrically connected or detached at will. A plug housing and a socket housing are each equipped internally with at least one contact point. Provided on a sidewall of either the plug housing or the socket housing is an engaging part, and provided on a sidewall of the other housing is a latching protrusion that engages the engaging part. A cover part is provided in the vicinity of the engaging part that covers a latching part of the latching protrusion that is otherwise exposed when in an engaged state with the engaging part. The cover part is provided with an opening from which the latching part is accessible when the latching protrusion is in an engaged state with the engaging part.

5 Claims, 2 Drawing Sheets

CONNECTOR WITH COVER FOR A LATCHING PART

CROSS-REFERENCE TO RELATED APPLICATION

The present application claims priority under 35 U.S.C. § 119 to Japanese Patent Application No. 2007-160444 filed on Jun. 18, 2007. The content of the application is incorporated herein by reference in its entirety.

TECHNICAL FIELD

The present invention relates to a connector for connecting electric power lines of solar cell modules or the like, or other electric lines.

BACKGROUND OF THE INVENTION

A conventional waterproof relay connector 1 for solar cell-use in described, for example in Japanese Unexamined Patent Application No. 2001-257027 filed Mar. 10, 2000, and Japanese Unexamined Patent Application No. 2002-009326, filed Jul. 26, 2000, each of which is hereby incorporated by reference herein in its entirety. A conventional waterproof relay connector of this type includes a plug 2 and a socket 3, with respective power line cables 4 were connected thereto, as illustrated in FIGS. 3 and 4. The plug 2 has a plug pin 6 provided in a protruding state inside a cylindrically-shaped plug housing 5, and is connected to the cable 4 power line. Additionally on a sidewall of the plug housing 5, are provided engaging parts 7 that are penetrated at mutually symmetric location in the axial direction.

The socket 3 is provided with a socket housing 8, equipped internally with a contact for connecting, into which the plug pin 6 in the plug 2 is inserted, and the contact connects to the cable 4 on the socket 3 side. Formed integrally on the sidewall of the socket housing 8 are latching protrusions 9, arranged at symmetrical locations, and projecting along the sidewall and toward the tip thereof. The latching protrusions 9 are inserted into the engaging parts 7, and latching parts 9*a* at the tip portions of latching protrusions 9 engage the edges of openings in the engaging parts 7, and latch so as not to be easily pulled out. Moreover, attached to the base of the socket housing 8 is a sealing member 10, such as an O-ring, that mates water-tightly with the plug housing so as to create a waterproof state in the interior where the contact is located.

In the case of the abovementioned prior art, even when the plug 2 and the socket 3 are engaged in a mated state for example as shown in FIG. 4, the engagement may dislodge due to the application of some external force against the latching parts 9*a* at the tip portions of latching protrusions 9 of the socket housing 8. For example, the engagement may dislodge easily as a result of holding and pinching the latching parts 9*a* in one's hand, causing the cable 4 connections to become dislodged inadvertently.

SUMMARY OF THE INVENTION

The present invention was devised in consideration of the abovementioned problems and it is an object of the present invention to provide a connector that has a simple structure, is easily connectable, and does not dislodge inadvertently.

A connector according to the present invention comprises a plug and a socket provided so as to be electrically connected or detached at will, each component being molded from synthetic resin, and having a plug housing and a socket housing equipped internally with a contact point; an engaging part provided on a sidewall of either the plug housing or the socket housing, and a latching protrusion, provided on another sidewall, that engages the engaging part; and a cover part, provided in the vicinity of the engaging part, that covers a latching part of the latching protrusion exposed to the exterior when in an engaged state with the engaging part.

The cover part is provided with an opening through which the latching part can be viewed when in the state where the latching protrusions are engaged in the engaging parts 7.

The plug and socket connect power cables for use with solar cells or the like, and thus are formed to provide a waterproof structure for the contacts when in a connected state.

The connector of the present invention is electrically stable and is not easily dislodged in the state where the plug and socket are connected. Moreover, the engagement can be dislodged by using a jig or the like, and this is also convenient for maintenance. Additionally, the engaged state can be confirmed easily since the latching part can be observed from the opening.

BRIEF DESCRIPTION OF THE DRAWINGS

The invention will become more readily apparent from the Detailed Description of the Invention, which proceeds with reference to the drawings, in which.

DETAILED DESCRIPTION OF THE INVENTION

Figure 1:
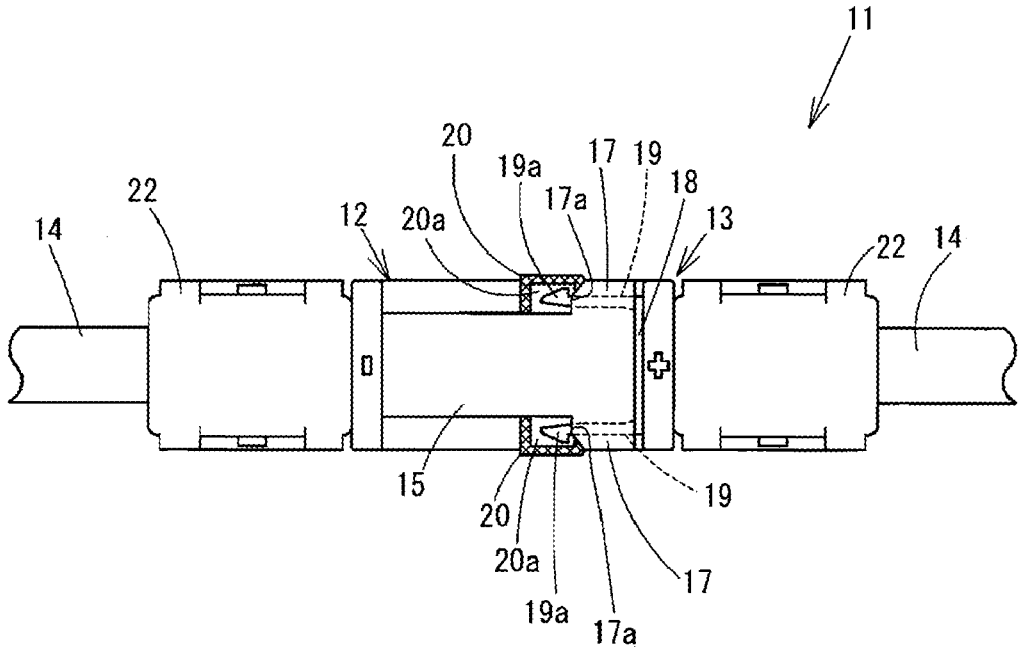
FIG. 1 is a plan view of a connector in an embodiment of the present invention.

The following table provides a key to a number of the reference numerals and elements depicted in the drawings.

Figure 2:
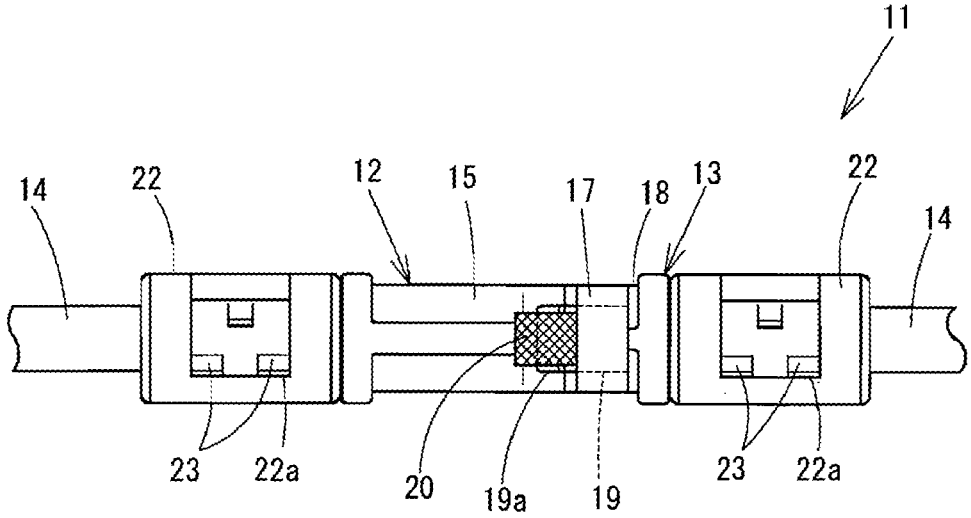
FIG. 2 is a front view of a connector in an embodiment of the present invention.
Figure 3:
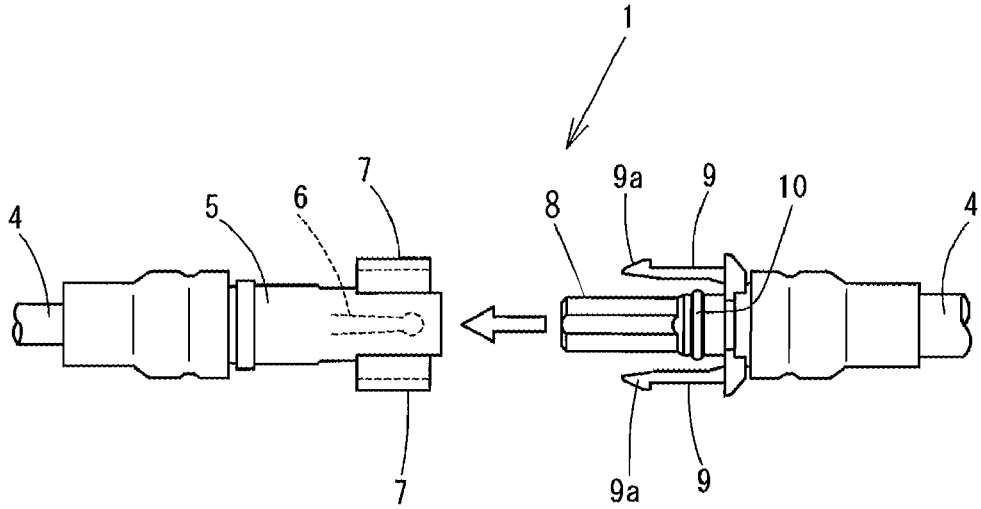
Fig. 3 (Prior Art)
FIG. 3 is a plan view of a conventional connector in a disengaged state.
Figure 4:
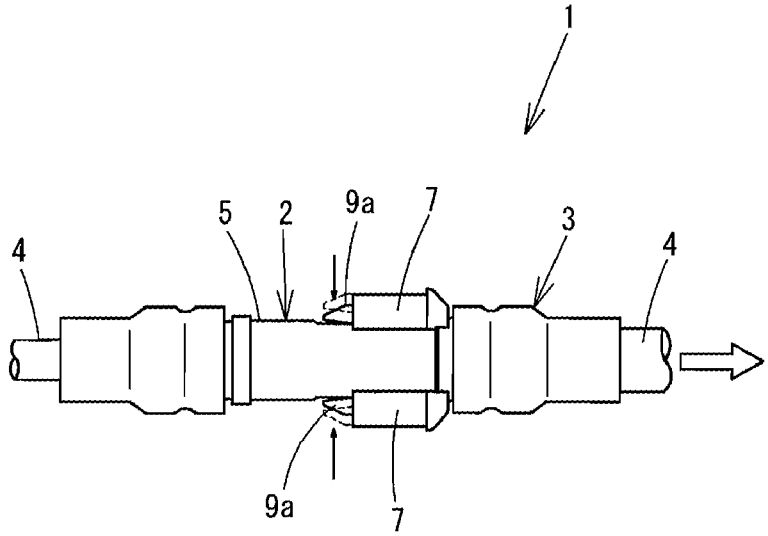
Fig. 4 (Prior Art)
FIG. 4 is a front view of a conventional connector in an engaged state.

11 Connector
12 Plug
13 Socket
14 Cable
15 Plug housing
17 Engaging part
17*a* Edge of opening
18 Socket housing
19 Latching protrusion
19*a* Latching part
20 Cover part
20*a* Opening An embodiment of the present invention is described below with reference to drawings. FIGS. 1 and 2 show an embodiment of the present invention, wherein a connector 11 is molded into a certain shape with synthetic resin and is, for example, a waterproof relay connector connected to a solar cell power cable. The connector 11 is comprised of a plug 12 and socket 13, and respective power cables 14 are connected thereto.

The plug 12, as in the prior art, may have one or more plug pins (not shown) provided in a protruding state inside a cylindrically-shaped plug housing 15, and is connected to a cable 14 power line. Additionally, on a sidewall of the plug housing 15 are provided tubular-shaped engaging parts 17, that are molded integrally with the plug housing 15, that extend in the axial direction and that are distributed preferably symmetrically around plug housing 15, in the radial direction.

The socket 13 is provided with a socket housing 18, equipped internally with a one or more contacts (not shown) into which the one or more plug pins (not shown) of the plug 12 are inserted, and the one or more contacts are connected to the cable 14 on the socket 13 side.

Formed integrally on the sidewall of the socket housing 18 are latching protrusions 19, distributed preferably symmetrically around the socket housing 18 in the radial direction, extending along the sidewall of the socket housing 18 and toward the tip thereof. As shown in the drawing, the latching protrusions 19 are inserted into the engaging parts 17. Latching parts 19*a* at tip portions of the latching protrusions 19 engage edges of openings in the engaging parts 17, and latch so as not to be easily pulled out in the direction of strain. Moreover, attached to the base of the socket housing 18 is a sealing member, such as an O-ring, that connects closely with the inner surface of the plug housing 15, and when in a mated state with the plug housing 15, mates water-tightly with the plug housing 15 so as to create a waterproof state in the interior where the contact is located.

In the vicinities of the openings of the engaging parts 17 of the plug housing 15 are formed cover parts 20 that cover the latching parts 19*a* of the latching protrusions 19 when in a mated state. The cover parts 20 cover the outer sides of the latching parts 19*a*, and on both sides thereof openings 20*a* are formed such that the latching parts 19*a* are exposed.

At the area where each cable 14 is coupled to the socket 13 and the plug 12, a cover member 22 is preferably mated and protects the sidewall. At the cover member 22, opening edges 22*a* of the sidewall of the cover member 22 engage and are secured by latching tabs 23 formed on the side walls of the plug 12 and the socket 13.

To release the coupling of the plug 12 and the socket 13 of the connector 11, a jig (not shown) is used, and the tip portion of the jig is inserted from the opening 20*a* of the cover part 20 and pressed so that the latching parts 19*a* symmetrically disposed on opposing sides of the socket housing 18 approach one another, thereby releasing the engagement between the latching parts 19*a* and the opening edge 17*a* of the engaging parts 17. Then, the plug 12 and the socket 13 are pulled so as to separate from one another, and the engagement is released.

With the connector 11 of this embodiment of the present invention, in the state where the latching protrusions 19 of the socket 13 are engaged in the engaging parts 17 of the plug 12, the latching parts 19*a* of the latching protrusions 19 are covered by the cover parts 20, thereby inhibiting contact with external members, so that no force is applied to the latching parts 19*a*. Furthermore, the opening 20*a* is formed in the cover part 20, and when dislodging the engagement, a jig is used to enable easy separation, and this is convenient for releasing the connection when performing maintenance.

The present invention is not limited to the above-described embodiment, and is applicable to the coupling of a variety of plugs and sockets for appropriate uses. For example, the engaging part and the latching protrusion may alternatively be provided, with respect to the plug housing and socket housing, oppositely from the above-described embodiment, or may be provided alternatively with reference either to the plug housing or socket housing as an engaging part mounted on one sidewall and a latching part, mounted on another sidewall, that engages the engaging part. It is also within the scope of the present invention to include all foreseeable equivalents to the structures described with reference to FIGS. 1 and 2.

The invention claimed is:

1. A connector, comprising:

a plug and a socket configured to be electrically connected or detached the connector comprising:

a plug housing and a socket housing each equipped internally with at least one contact point; the plug housing and the socket housing each being configured to be coupled to one another along a longitudinal direction of the connector, an engaging part provided on a sidewall of either the plug housing or the socket housing, a latching protrusion, provided on a sidewall of the other housing that engages the engaging part when the plug housing and the socket housing are coupled to one another, and a cover part, provided adjacent to the engaging part, the cover part being configured to cover a latching part of the latching protrusion when the latching protrusion is in an engaged state with the engaging part, and being further configured to include a first opening at a first lateral side of the cover from which the latching part is accessible when the latching protrusion is in an engaged state with the engaging part.

2. The connector according to claim 1, wherein the plug and the socket connect power cables for solar cell use, and form a waterproof structure for contact points when in a connected state.

3. The connector according to claim 1, wherein one or more of the plug housing and the socket housing are molded from a synthetic resin.

4. The connector according to claim 1, wherein the cover further includes a second opening at a second lateral side of the cover opposite to the first lateral side.

5. The connector according to claim 1, wherein an engagement state of the latching protrusion with the engaging part is visible at the first opening.

* * * * *